US008241156B2

(12) United States Patent
Sims et al.

(10) Patent No.: US 8,241,156 B2
(45) Date of Patent: Aug. 14, 2012

(54) SHOCK/VIBRATION DAMPENING

(76) Inventors: Steven C. Sims, Shelton, WA (US); Johnathan F. Seil, Shelton, WA (US); Gary Sims, Shelton, WA (US); Greg Winters, Shelton, WA (US)

( * ) Notice: Subject to any disclaimer, the term of this patent is extended or adjusted under 35 U.S.C. 154(b) by 883 days.

(21) Appl. No.: 11/732,701

(22) Filed: Apr. 3, 2007

(65) Prior Publication Data

US 2007/0259743 A1 Nov. 8, 2007

Related U.S. Application Data

(60) Provisional application No. 60/797,257, filed on May 3, 2006.

(51) Int. Cl.
*F42B 6/04* (2006.01)

(52) U.S. Cl. ..... 473/578

(58) Field of Classification Search ..... 124/89; 473/578; 215/355
See application file for complete search history.

(56) References Cited

U.S. PATENT DOCUMENTS 3,670,712 A * 6/1972 Izuta ..... 124/89
5,351,973 A * 10/1994 Taniuchi et al. ..... 277/616
5,562,494 A * 10/1996 Fujiwara ..... 439/587
5,607,364 A * 3/1997 Hedrick et al. ..... 473/318
5,718,643 A * 2/1998 Wright et al. ..... 473/297
5,720,487 A * 2/1998 Kato ..... 277/637
5,947,326 A * 9/1999 O'Hern et al. ..... 220/802
6,036,541 A * 3/2000 Koumatsu ..... 439/587
6,231,456 B1 * 5/2001 Rennie et al. ..... 473/316
6,277,041 B1 * 8/2001 Fenn ..... 473/578
6,595,868 B1 * 7/2003 Androlia ..... 473/318
6,669,585 B2 * 12/2003 Sutherland et al. ..... 473/581
6,802,307 B2 * 10/2004 Leven ..... 124/89
RE38,983 E * 2/2006 Antonious ..... 473/317
2005/0137026 A1 * 6/2005 Stites et al. ..... 473/318
2006/0052190 A1 * 3/2006 Palomaki et al. ..... 473/578
2008/0085793 A1 * 4/2008 Palomaki et al. ..... 473/586

* cited by examiner

*Primary Examiner* — John Ricci

(57) ABSTRACT

Vibration dampening devices for arrows are installed in the arrow point end of the arrow shaft or in the nock end of the shaft or in both of those ends. These devices: (a) are fabricated from elastomeric materials; (b) have an elongated core surrounded by one or more annular, vibration dampening elements; and (c) employ decay time modification to attenuate shock and vibration. The devices are assembled in axially aligned relationship to an arrow point insert or arrow nock, and coupling features insure a positive connection between the dampening device and the arrow point insert or nock to which a device is assembled.

28 Claims, 9 Drawing Sheets

SHOCK/VIBRATION DAMPENING

CROSS-REFERENCE TO A RELATED APPLICATION

This application is related to and claims the benefit of the 3 May 2006 filing date of provisional patent application No. 60/797,257.

TECHNICAL FIELD OF THE INVENTION

In one aspect, the present invention relates to the shock/vibration dampening and settling of an arrow as the arrow is shot (or launched) from a bow.

In another aspect, the present invention relates to novel, improved, shock/vibration dampeners which are constructed and configured for installation in the hollow shaft of an arrow.

And, in still another aspect, the present invention relates to arrows which have novel shock/vibration dampeners of the character described in the preceding paragraph and to assemblies of the dampener and an arrow component.

DEFINITIONS

An arrow as that term is employed herein is an artifact with an elongated shaft configured and constructed to receive an arrow point at one end and a nock at the opposite end. Arrows as herein defined include those designed for cross bows and sometimes referred to as quarrels or bolts.

A vibration dampener is a device which is fabricated from an elastomeric material and has a feature for attaching it in end-to-end relationship to a rigid arrow point insert or to a nock. The term "vibration dampener" is intended to identify devices which dampen shocks as well as vibrations.

BACKGROUND OF THE INVENTION

The accuracy with which an arrow can be shot from a bow is of the utmost importance to all archers—bow hunters, target archers, those who use bows for fishing, and others. An arrow which is quiet in flight is also very important, perhaps most particularly to a bow hunter. A third feature, important in many types of archery, is an arrow which will minimize the damage which ensues if an arrow strikes one which was previously shot.

Accuracy of a shot depends to a large part on how quickly an arrow can be made to settle and thereby assume a stable flight path when it is shot from a bow. An arrow which settles quickly is one which is also quiet in flight.

Settling time can be shortened by decay time modification after the arrow has left the bow. The reduction in setting time is accompanied by an increase in accuracy.

Minimization of shock and vibration by decay time modification can minimize the damage which occurs when an arrow strikes an arrow that has previously struck a target. Furthermore, the minimization of shock and vibration has the potential to decrease drag by minimizing flutter, thereby increasing the flight distance of an arrow.

SUMMARY OF THE INVENTION

These important goals of settling time minimization and damage limitation are realized in accord with the principles of the present invention by installing a vibration dampener (vibration dampening device) in the shaft of an arrow. The dampener can be located at either the point end or the nock end of the arrow or at both the arrow point and nock ends.

Dampeners which are useful for the stated purposes employ decay time modification to minimize shock and vibration. They are fabricated from an elastomer, preferably though not necessarily a NAVCOM® material. Acceptable performance typically dictates that the elastomer have a Shore A hardness in the range of ca. 12-20.

The novel dampeners disclosed herein have an elongated body surrounded by one or more integral, annular vibration dampening elements. When shock and/or vibrations reach the dampener, its components, especially the annular dampening element(s), are so macroscopically and elastically displaced as to very rapidly reduce the time required for the shock and/or vibrations to decay to a harmless, very low level. This removes the factors which keep an arrow from settling, allowing this to occur very quickly and produce the wanted stable and quiet flight.

Annular dampening elements as described above are typically located toward one end of the dampener body with which they are integrated and dimensioned for a high tolerance slip fit in the shaft in which the dampener is installed (a typical slip fit is one in which the maximum diameter of a vibration dampener is smaller by less than 0.005 inch relative to the inside diameter of an arrow shaft in which the dampener is installed). This leaves an opposite, tip end portion of the dampener body free to wiggle and jiggle when shocks or vibrations are impressed on the dampener, a phenomenon which can significantly increase the effectiveness of the dampener. Also, the high tolerance slip fit provides for decay time modification by sliding friction between the dampening element and the inside wall of the hollow arrow shaft, by the dampener acting to resist motion of the arrow shaft, and by elastic deformation of the elastomeric dampener material.

The preferred placement of the dampening elements is off-center with respect to an active segment of the device—for example, that segment between a coupling segment at one end of the device and a tip at the opposite end. The preferred off-center locational relationship of the dampening element(s) also enhances the functioning of the dampening device by keeping the device from resonating in phase with the shaft of the arrow in which the dampening device is installed.

Yet another approach that can be employed to advantage is to employ a set of integral annular elements located along the entire length of the dampener's body component. This increases the number of vibration dampening elements, potentially adding to the decay time modifying ability of a dampener embodying the principles of the present invention.

A dampener as disclosed herein is installed by slipping (or pressing) it into the hollow shaft of an arrow. This may increase the air pressure in the shaft to a level at which the dampener will pop back out of the shaft when the installation force is removed. This can be avoided by providing an end-to-end axial bore through the dampener.

As stated above, dampeners embodying the principles of the present invention can be installed at either the point end or the nock end of an arrow. At the point end, the dampener can be pre-assembled before installation to the insert commonly provided to attach a point to the arrow shaft. At the nock end of an arrow, the dampener is attached directly to the nock in a pre-installation step in the preferred manner of installing the dampener.

As indicated above, the novel dampeners disclosed herein are preferably dimensioned for high tolerance slip fit in with the arrow shafts in which they are installed, perhaps making it difficult to press the dampener into the shaft. The shaft-engaging surfaces of the dampener may in this case be lubricated before attempting to install the dampener. An epoxy adhesive capable of bonding the dampener to the arrow shaft or any other appropriate adhesive may be employed.

Other objects, features, and advantages of the invention will be apparent to the reader from the foregoing and the appended claims and as the ensuing description and discussion proceeds in conjunction with the accompanying drawings.

DETAILED DESCRIPTION OF THE INVENTION

Figure 1:
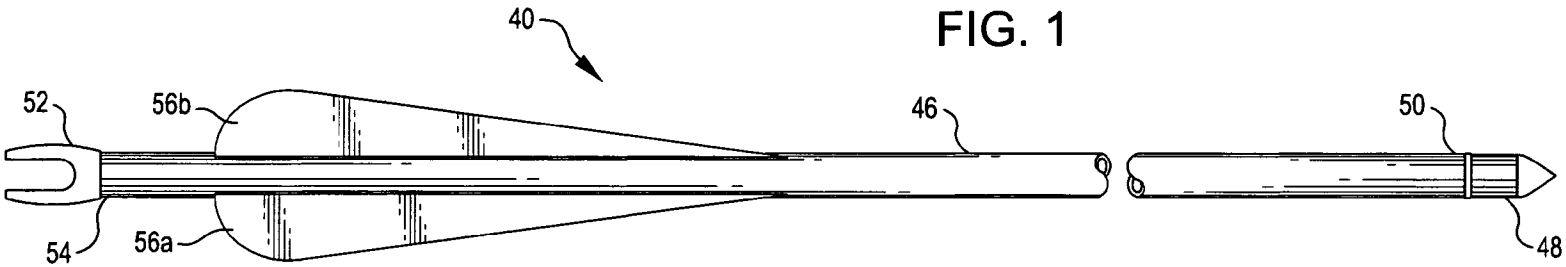
FIG. 1 is a side view of an arrow equipped with a point, a nock, and internal, slip fitting, point end and nock end vibration dampeners; the vibration dampeners embody the principles of the present invention and are constructed and installed in the arrow in accord with those principles.

Referring now to the drawings, FIGS. 1, 2, 2A, 2B, 3, and 3A depict an arrow 40 equipped with: (1) a point end vibration dampener 42, and (2) a nock end vibration dampener 44. Both dampeners are constructed in accord with the principles of the present invention and installed in arrow 40 in accord with those principles.

Arrow 40 has a hollow shaft 46, an arrow point 48 at the rear end 50 of the shaft, and a nock 52 at the front end 54 of the shaft. Fletches 56*a-c* of conventional construction are mounted to arrow shaft 46 toward its front end 54.

Figure 2:
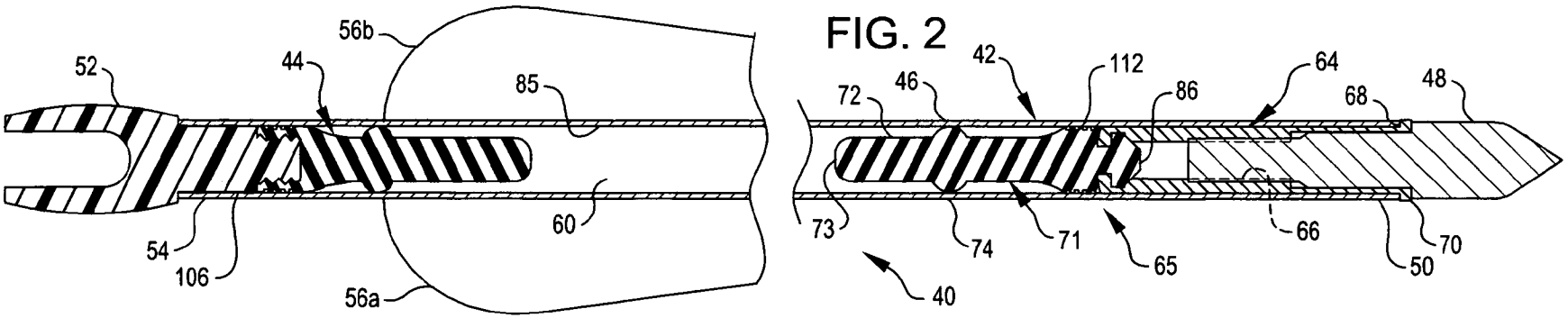
FIG. 2 is a longitudinal section through the FIG. 1 arrow, arrow point, nock, both vibration dampeners, and an arrow point insert to which the point end vibration damper is assembled.
Figure 3B:
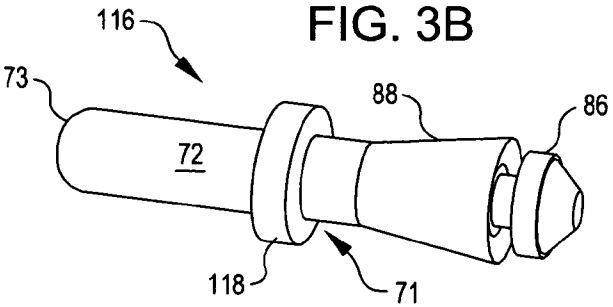
FIG. 3B is a side view of a second, slip fitting, vibration dampening device embodying the principles of the present invention; this device has an alternate dampening element configuration that may also be employed in many, if not most, dampeners embodying those principles.
Figure 2A:
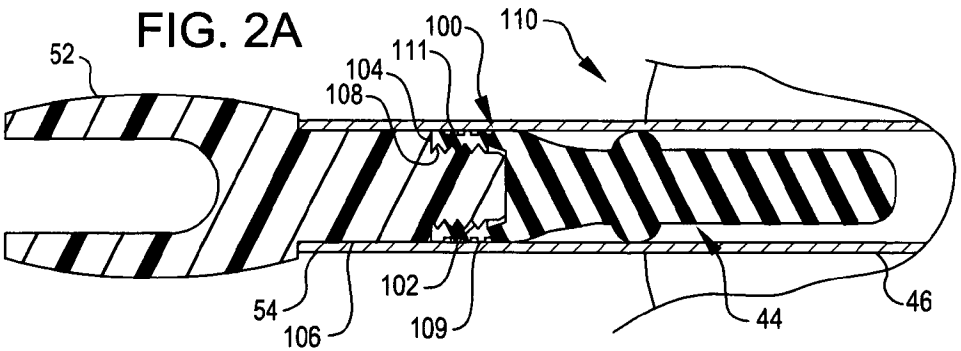
FIG. 2A is a first, enlarged scale fragment of FIG. 2.
Figure 3:
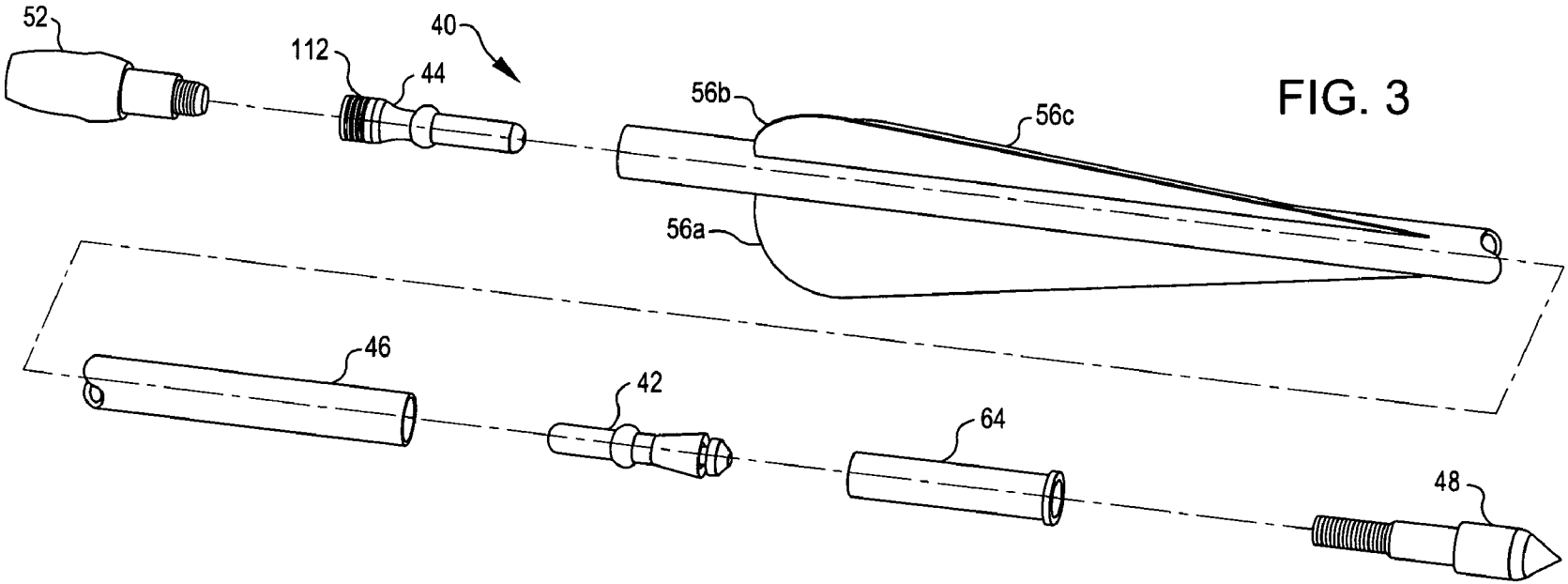
FIG. 3 is an exploded view of: (a) the FIG. 1 arrow; (b) the nock and nock end vibration dampener; (c) the point end vibration dampener; (d) the arrow point insert, and (e) the arrow point.

Referring now to FIGS. 2, 2A, and 3, point end vibration dampener 42 is dimensioned for a high tolerance slip fit in arrow shaft 46 and is installed in the hollow interior 60 of the shaft toward the rear end 50 of the shaft. Nock end vibration dampener 44 is similarly dimensioned for a high tolerance slip fit in arrow shaft 46 and is installed in the interior 60 of the shaft adjacent the forward, front end 54 of the shaft.

Dampener 42 is preassembled in end-to-relationship to an arrow insert 64. The dampener/insert assembly 65 is installed by sliding it into hollow shaft interior 60 with insert 64 between dampener 42 and the rear end 50 of the arrow shaft.

Arrow point 48 and insert 64 have complementary external and internal threads collectively identified in FIG. 2 by reference character 66. After installation of assembly 65, arrow point 48 is threaded into insert 64 until an annular ledge 68 on the arrow point engages and is tightened against the rear end 50 of arrow shaft 46. An annular lip 70 at the rear end of arrow point insert 64 is at this juncture trapped between ledge 68 and shaft end 50 to retain the insert and the dampener 42 assembled to insert 64 in place in shaft 46.

Point end vibration dampener 42 has an elongated core 71 with a tip at one end. Tip 72 is free to wiggle and jiggle in the interior 60 of hollow arrow shaft 46 and thereby advantageously contribute to modification of the decay time of vibrations transmitted to the dampener. Tip 72 terminates in a freely movable, exposed end 73.

The opposite end of vibration dampener 42 is an integral coupling segment 82, provided for assembling dampening device 42 to arrow insert 64.

An integral, off-center, quasi-toroidal dampening element 74, which surrounds dampener core 72, is located toward the coupling segment end 82 of the dampener (the right-hand end as seen in FIG. 2A in which the longitudinal center of the pertinent core segment 75 is identified by centerline 76). Without comprising the dampening function of element 74, this leaves the tip 72 of the dampening device free to wiggle and jiggle without setting up unwanted, performance-degrading frequencies in arrow 40 as the dampening element 74 might do if it were centered along the core 71 of dampening device 42.

The coupling segment 82 of dampening device 42 has a frustoconical head 86 and a recess 87 located between head 82 and a tapered element 88 of the dampener. Element 88 is dimensioned to have a slip fit in the hollow interior 60 of arrow shaft 46.

The front end 88 of arrow point insert 64 has a complementary coupling segment 89 with a flange 90 and an adjoining, annular, frustoconical recess 92.

Dampening device 42 and arrow point insert 64 are preassembled by effecting relative movement between these two components in directions indicated by arrows 94 and 96 in FIG. 2.

This relative movement is continued until the frustoconical head 88 of vibration dampener 42 snaps into the complementary annular, frustoconical recess 92 at the front end of arrow point insert 64. That traps dampening device 42 between the side wall 98 of the insert and the flange 90 at the forward end of that component, thus positively locking or coupling vibration dampening device 42 and insert 64 together.

To a considerable extent, the slip fitting nock end vibration dampening device 44 shown in FIGS. 2 and 2A resembles point end dampening device 42; and common elements of the two dampening devices have accordingly been identified by the same reference characters.

Dampening device 44 differs from the device of that character at the point end of arrow 40 in that it has a coupling segment 100 with an internally threaded recess 102. This recess opens onto the forward end 104 of the device.

Nock 48 has a complementary, longitudinally extending, externally threaded lug or boss 106. The internal and external threads are collectively identified in FIG. 2B by reference characters 108 and 109.

Nock 48 and vibration dampener 44 are preassembled by threading these components together. The resulting assembly 110 is then slid into hollow shaft 60 with dampening device segment 111 and dampening elements 74 . . . 80 having a slip fit relative to the interior wall side 85 of arrow shaft 60.

A set of juxtaposed annular grooves 112 on the outer side 114 of dampening device coupling segment 100 (see FIG. 2A) allows the damping device material to give as necessary to the extent that the dampening device/insert assembly 110 can be slid into the interior 60 of arrow shaft 46.

To the same end, assembly-facilitating grooves may be formed on the exterior of any of the other dampening devices disclosed hereinafter, including point end dampener 42 (see FIGS. 2, 2B, and 3A).

In those embodiments of the invention described below, elements common to those embodiments and the vibration dampeners shown in FIGS. 2, 2A, 2B, 3, and 3A will again be identified by the same reference characters.

The slip fitting vibration dampening device 116 illustrated in FIG. 3B is essentially like the just-described device 42, but differs in that it has an integral dampening element 118 with the configuration of a thick washer rather than the toroidal configuration of the device 42 dampening element 74. Like element 74, the dampening element 118 of dampening device 116 has a longitudinally off-center relationship with the elongated core 71 of the device, allowing the tip 72 of device 116 to wiggle and jiggle.

Figure 4:
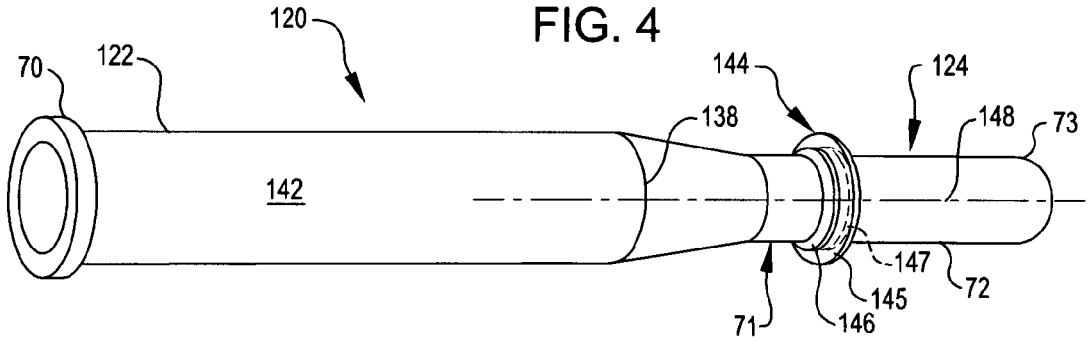
FIG. 4 is an isometric view of a third, slip fitting, point end vibration dampener and arrow point insert assembly; the assembly, dampener, and insert all embody the principles of the present invention.
Figure 5:
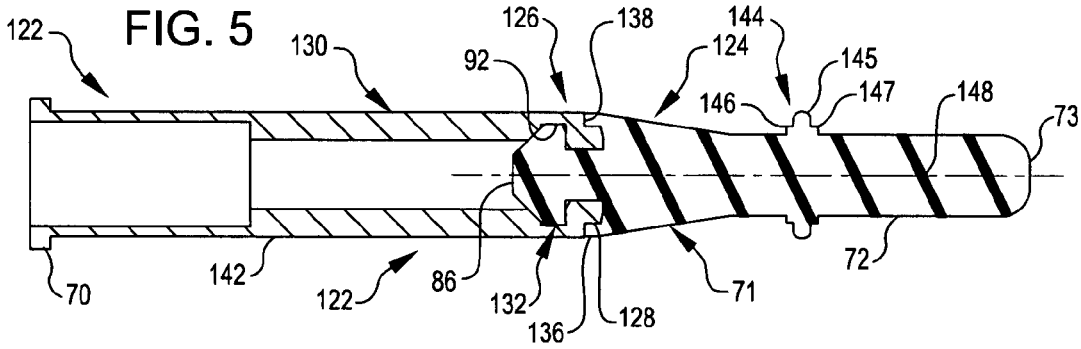
FIG. 5 is a longitudinal section through the assembled point end vibration dampener and the arrow point insert.
Figure 6:
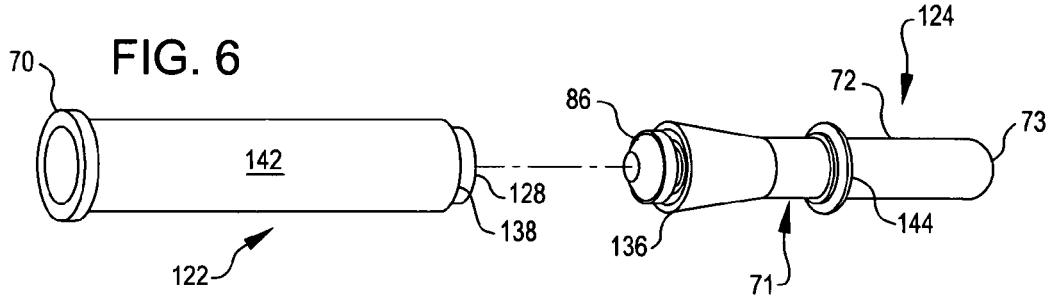
FIG. 6 is an exploded view of the point end vibration dampener and the arrow point insert.

Returning then to the drawings, FIGS. 4-6 depict an assembly 120 of an arrow point insert 122 and a slip fitting vibration dampening device 124. Insert 120 has a coupling segment 126 which includes the reduced diameter end 128 of a stepped-down insert barrel 130.

The complementary coupling segment 132 of vibration dampening device 124 is akin to the coupling segment 82 of dampener 42 except that coupling segment 132 has an annular end segment 136 which surrounds point insert end 128 and butts against a ledge 138 at the junction of that end and the body 142 of point insert barrel 130.

As is best shown in FIG. 5, dampening device 134 also has an integral, annular, off-center dampening element 144 with a configuration different from the corresponding element 74 of device 42. Specifically, dampening element 144 has an annular disk 145 and integral stubs 146 and 147, which are centered on the axial centerline 148 of dampening element 144 and extend in opposite directions from disk 145.

Figure 7:
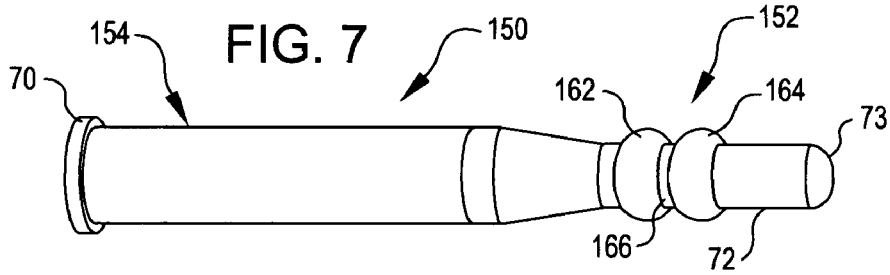
FIG. 7 is an isometric view of a fourth, slip fitting, point end vibration dampener and arrow point insert assembly; the assembly, dampener, and insert all embody the principles of the present invention.
Figure 8:
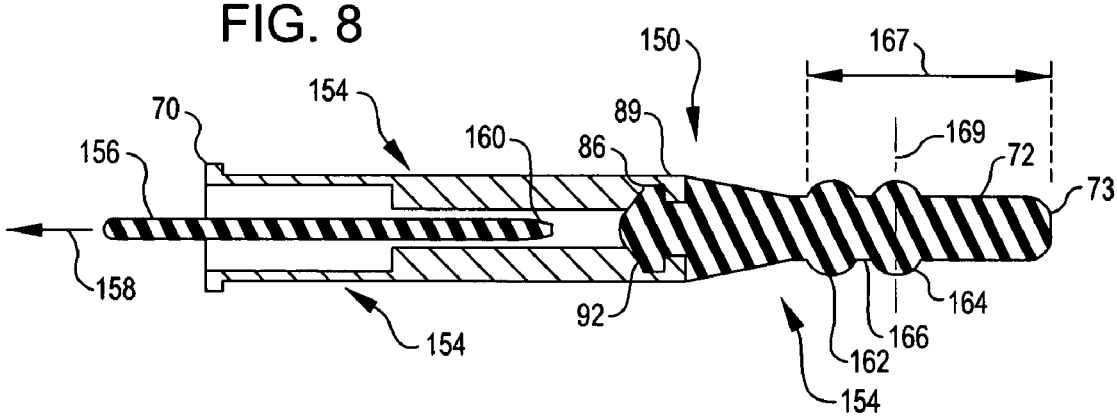
FIG. 8 is a longitudinal section through the assembly of FIG. 7.
Figure 9:
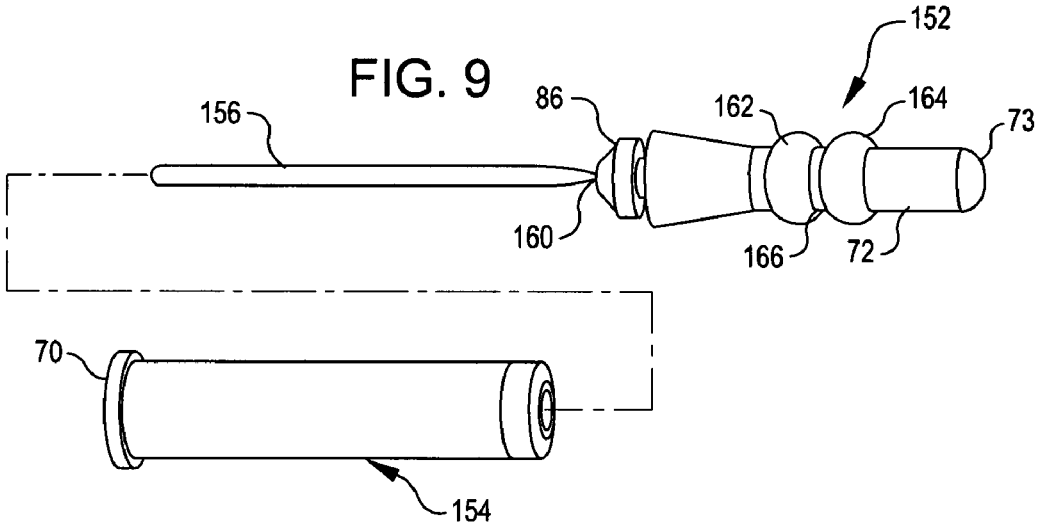
FIG. 9 is an exploded view of the assembled FIG. 7 vibration dampener and arrow point insert.

FIGS. 7-9 depict an assembly 150 of a slip fitting vibration dampening device 152 and an arrow point insert 154.

Dampening device 152 differs from those discussed above in that an integral, elongated tail 156 extends longitudinally from the head 86 of the dampening device to and through insert 154.

Pulling on tail 156 in the direction indicated by arrow 158 in FIG. 9 draws the dampening device into the bore 160 of the insert 154 and snaps head 86 into insert recess 92.

Tail 156 has a weakened end segment 162 at the location where the tail is integrated with the head 86 of dampening device 152. Once dampening device head 186 is seated in insert recess 92, a firm pull or yank on tail 156 will easily detach the tail from dampening device 152.

Dampening device assembly 150 also differs from the dampening device assemblies previously disclosed in that its vibration dampener 152 has multiple, off-center dampening elements rather than a single dampening element as the latter do. These dampening elements, identified by reference characters 162 and 164, are integral with and located along the core 71 of vibration dampener 152 with a short gap 166 between the two dampening elements.

That dampening elements 162 and 164 are off-center with respect to the relevant section 167 of dampening device core 71 is made clear by the locational relationship of the dampening elements 162 and 164 to the center of section 167, which is identified by centerline 169.

Figure 10:
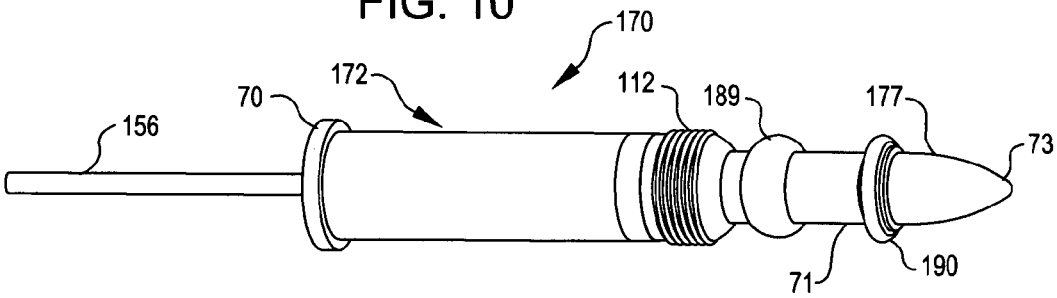
FIG. 10 is an isometric view of a fifth, slip fitting, point end vibration dampener and arrow point insert assembly; the assembly, dampener, and insert all embody the principles of the present invention.
Figure 11:
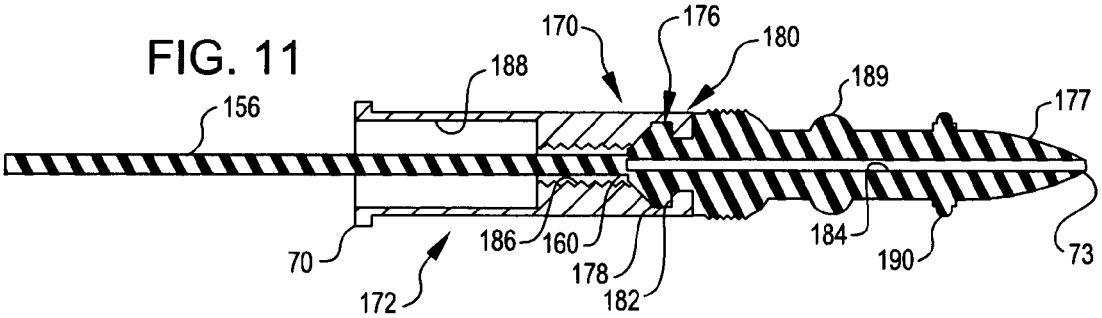
FIG. 11 is a longitudinal section through the assembly of FIG. 10.
Figure 12:
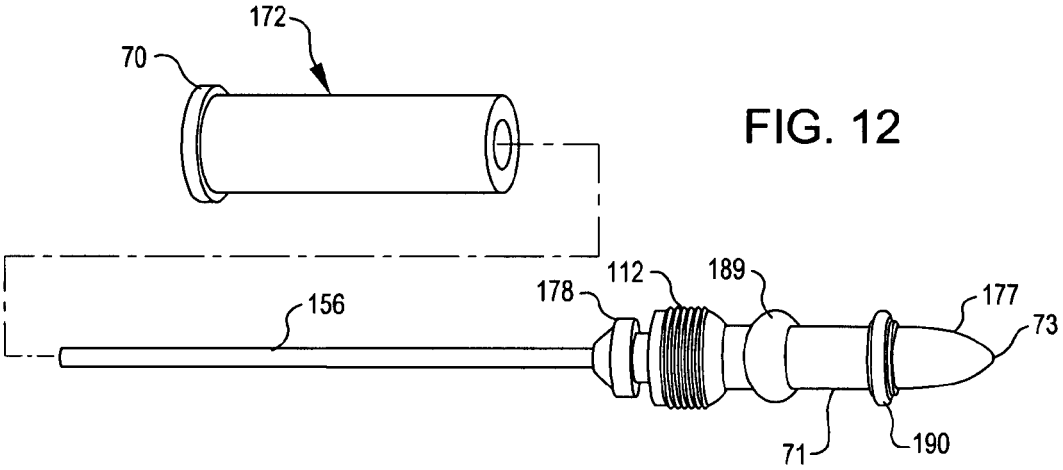
FIG. 12 is an exploded view of the FIG. 10 vibration dampener and arrow point insert.
Figure 13:
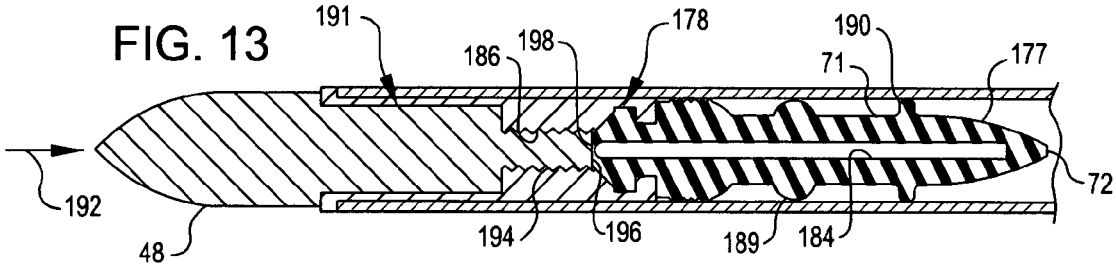
FIG. 13 is a section through the point end of an arrow as shown in FIG. 1 with the FIG. 10 vibration dampener installed and an assembly-facilitating tail of the dampener removed; this figure also shows the installed arrow point insert and an arrow point threaded into the insert to mount the point to the arrow.

FIGS. 10-12 depict an assembly 170 of an arrow point insert 172 and a slip fitting, point end vibration dampener 174. FIG. 13 shows the assembly 170 installed in the hollow shaft 60 of arrow 40 and also shows the arrow point 48 mounted to the arrow point insert 172 of assembly 170.

Figure 2B:
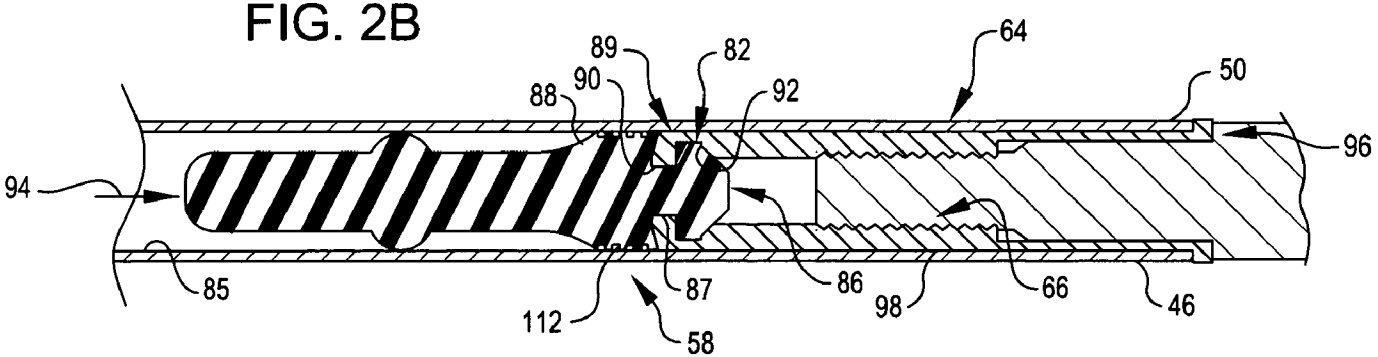
FIG. 2B is a second, enlarged scale fragment of FIG. 2.
Figure 3A:
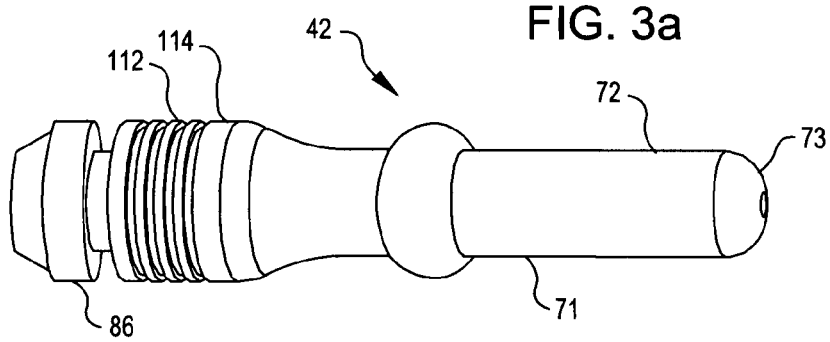
FIG. 3A is an enlarged scale view of the point end vibration dampener shown in FIG. 3; except for scale, the two views are essentially alike.

Vibration dampening device 174 has a conical, tapered tip 177 and a coupling segment 176 with a snap-in head 178 resembling the dampener head 86 shown in FIGS. 2 and 2B.

A coupling segment 180 of insert 172 has a recess 182 with a complementary head-receiving configuration.

There is a bore 184 extending from end-to-end through dampening device 174. This passage communicates with the ambient surroundings through arrow point insert central bore segments 186 and 188 when dampening device/arrow point insert assembly 170 is pressed into arrow shaft 60 and tail 156 then removed. This relieves any air pressure which might have built up in the interior of shaft 60 as assembly 170 is pressed in place. The build-up of significant pressure in arrow shaft 60 is to be avoided as this pressure might possibly reach a level sufficiently high to pop assembly 170 out of the arrow shaft when the installation pressure on assembly 170 is released.

Bore 184 also reduces the area of tail 156 at the end 160 of the tail. This provides for easy removal of the tail after assembly 170 is installed.

Vibration dampening device 152 has two integral, off-center dampening elements 189 and 190. These elements are spaced along the core 71 of device 152. Inboard dampening element 189 has the quasi-toroidal configuration described above, and outboard dampening element 190 has the shouldered disk configuration best shown in FIGS. 4-6.

Referring now most particularly to FIG. 13, arrow point 48 is mounted to arrow point insert 172 after dampening device tail 156 is removed. The arrow point shaft 191 is slid into the insert as indicated by arrow 192 in FIG. 13. Then, externally threaded segment 194 of arrow point shaft 191 is threaded into the internally threaded section 186 of insert 172 until the annular ledge 68 on arrow point 48 is seated against the lip 70 of arrow point insert 172. At this point, the end 196 of threaded arrow point shaft 191 is pressed against the apposed end 198 of vibration dampening device 174, compressing the elastomeric material from which the dampening device is fabricated. This provides a frictional lock between arrow point 48 and insert 172, keeping the arrow point 48 from unscrewing during use of arrow 40.

Figure 14:
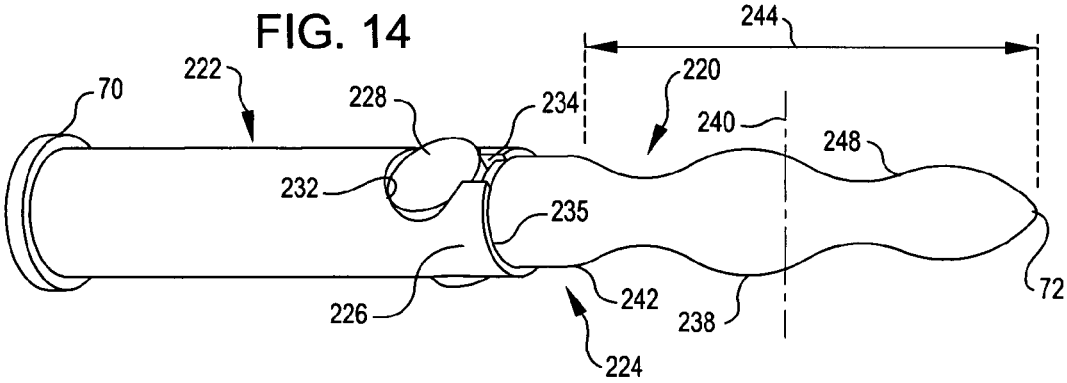
FIG. 14 is an isometric view of a sixth, slip fitting, point end vibration dampener and arrow point insert assembly; the assembly, dampener, and insert all embody the principles of the present invention.
Figure 15:
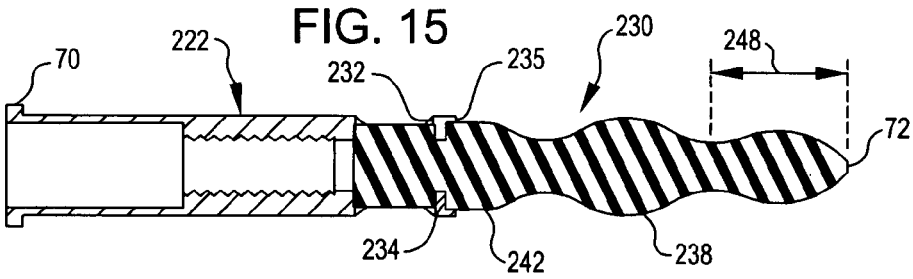
FIG. 15 is a longitudinal section through the assembly of FIG. 14.
Figure 16:
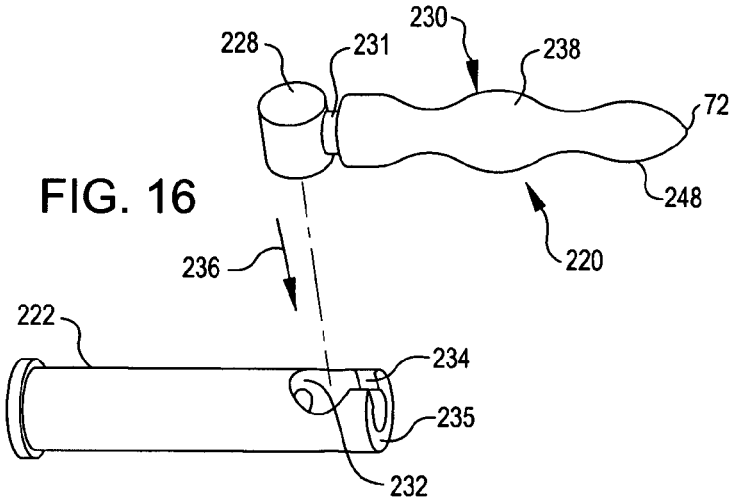
FIG. 16 is an exploded view of the FIG. 14 vibration dampener and arrow point insert.

FIGS. 14-16 depict an assembly 220 of an arrow point insert 222 and a slip fitting vibration dampening device 224. Vibration dampening device 224 differs from those discussed previously in that the coupling segment 226 of the device is a transversely-oriented knob (or head) 228 connected to a body 230 of the device by an integral transition segment 231.

Arrow point insert 222 has a transverse cut-out 232 configured and dimensioned to accept the knob 228 of dampening device 224 in a slip fitting relationship and a communicating slot 234 for the transition segment 231 of dampening device 224. Slot 234 opens onto end 235 of the insert.

The components of assembly 220 are joined together by pressing dampening device knob 228 sideways through arrow point insert cut-out 232 as indicated by arrow 236 in FIG. 14. Transition segment 231 of dampening device slides through the slot 234 in insert 222 as knob 228 moves in the arrow 236 direction.

With assembly 220 installed, the side wall 238 of arrow shaft 60 keeps knob 228 in arrow point insert 222.

FIGS. 14-16 also introduce yet another way of providing vibration dampening devices embodying the principles of the present invention with off-center dampening elements and further show that the devices need not have straight-sided configurations of those previously discussed dampening devices do.

The elongated, slip fitting, dampening device 224 illustrated in FIGS. 14-16 has a sinusoidal profile rather than a straight one; and an integral dampening element is provided by a node 238 in the dampener. Centerline 240 shows that this node is offset, being closer to the proximate end 242 of the pertinent dampener segment 244 than it is to the tip end 72 of the dampener. This leaves tip 248 free to wiggle and jiggle and effectively modify the decay time of vibrations set up in the dampening device.

Figure 17:
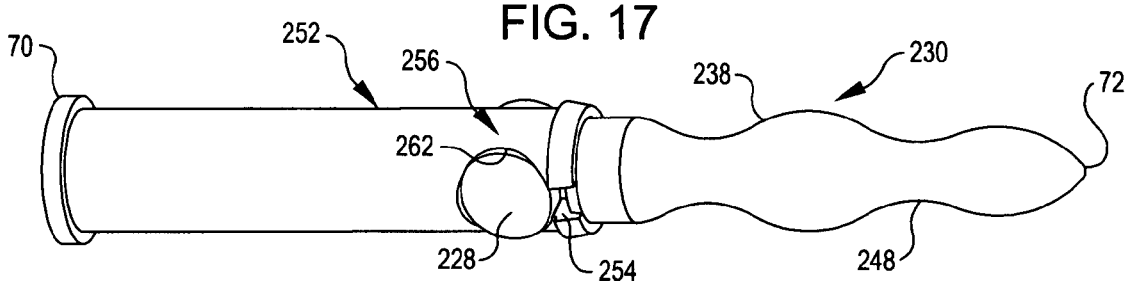
FIG. 17 is an isometric view of a seventh, slip fitting, point end vibration dampener and arrow point insert assembly; the assembly, dampener, and insert all embody the principles of the present invention.
Figure 18:
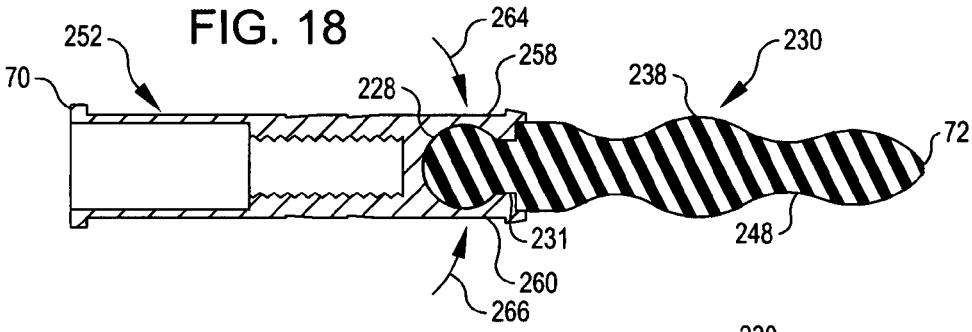
FIG. 18 is a longitudinal section through the assembly of FIG. 17.
Figure 19:
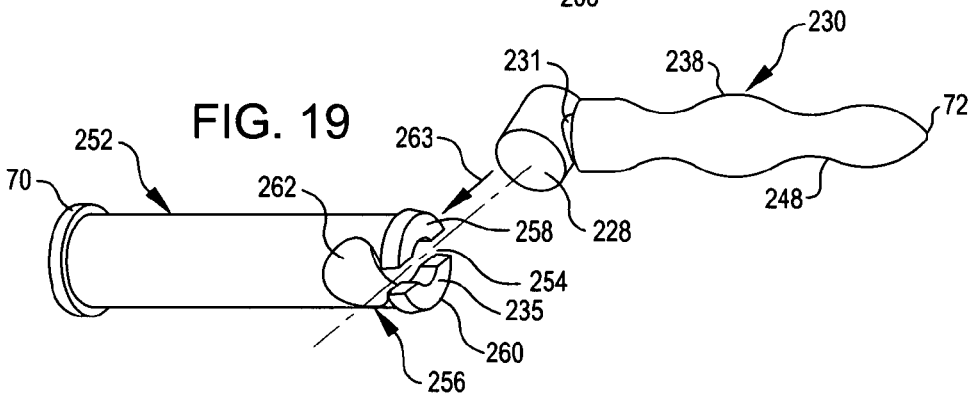
FIG. 19 is an exploded view of the FIG. 17 vibration dampener and arrow point insert.

The assembly 250 of arrow point insert 252 and vibration dampening device 224 shown in FIGS. 17-19 differs from the assembly 220 just described primarily in that the slot 234 in which dampening device transition segment 231 is seated cuts through two opposite sides of the insert. Slot 234 and cut-out 232 divide the coupling segment 256 of insert 252 into two facing, resiliently displaceable elements (or jaws) 258 and 260. When the transverse head 228 of dampening device 230 is pressed through the communicating cut-out 262 (see arrow 263), the transition segment 231 of dampening device 230 forces jaws 258 and 260 apart as indicated by arrows 264 and 266 in FIG. 19. Thereafter, because of their resiliency, jaws 258 and 260 restore toward each other; i.e., in directions opposite those indicated by arrows 264 and 266. The result is that the dampening device transition section 231 and head 228 are clamped between jaws 258 and 260, firmly securing the transverse head 228 of the dampening device 230 in arrow point insert 252.

FIGS. 20-23 depict: (a) yet another elastomeric, vibration dampening device 270 embodying the principles of the present invention; (b) a point end assembly 272 in which dampening device 270 is joined to an arrow point insert 274; and (c) a second, nock end assembly 276 in which dampening device 270 is mounted to arrow nock 277. Both dampening devices are dimensioned for a high tolerance slip fit in arrow shaft 46.

Dampening device 270 differs from the previously described devices of that character primarily in that it has annular, integral, dampening devices 278*a-e*—in this embodiment, quasi-toroidal—spaced the length of dampening device core 280. As in the vibration dampening devices discussed above, dampening element 278 accommodates performance-enhancing jijggling and flopping of the tip 288 of the device.

Dampening device 270 is assembled to arrow point insert 274 by sliding an end segment 282 of the device into a complementary socket 284 opening onto the front end 286 of the insert.

The dampening device 270 is assembled to nock 277 in essentially the same manner as it is to arrow point insert 274; in this case, by sliding end segment 282 of the device into a complementary socket 288 in the stem 290 of nock 277.

Figure 20:
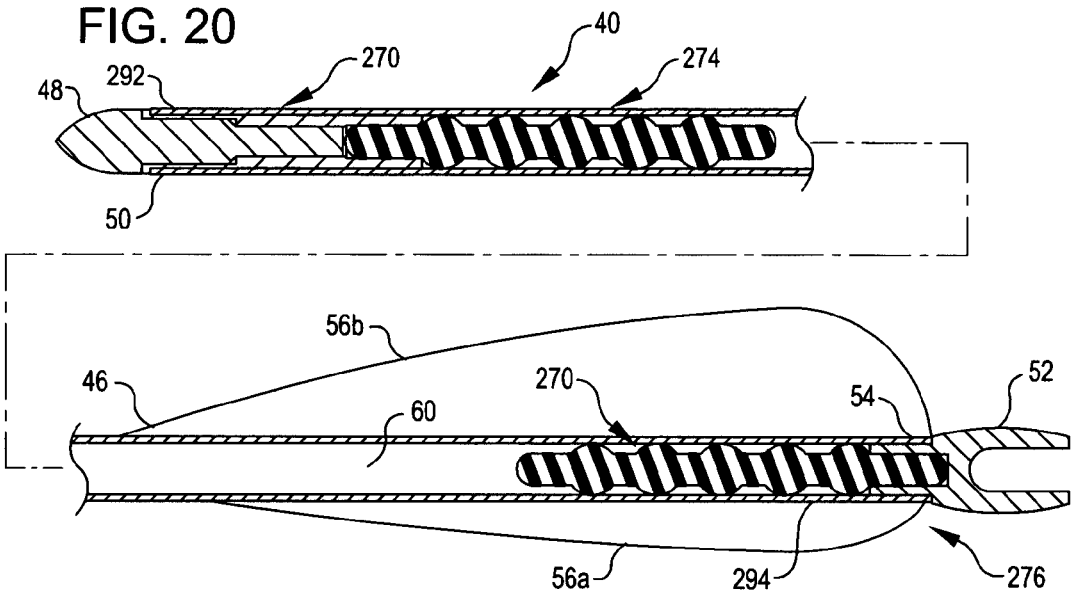
FIG. 20 is a section through an arrow which has a hollow shaft and is equipped with an eighth point end vibration dampener and a second, also slip fitting, nock end vibration dampener, both constructed in accord with the principles of the present invention; also shown in this figure are a point end arrow insert, an arrow point, and a nock.
Figure 21:
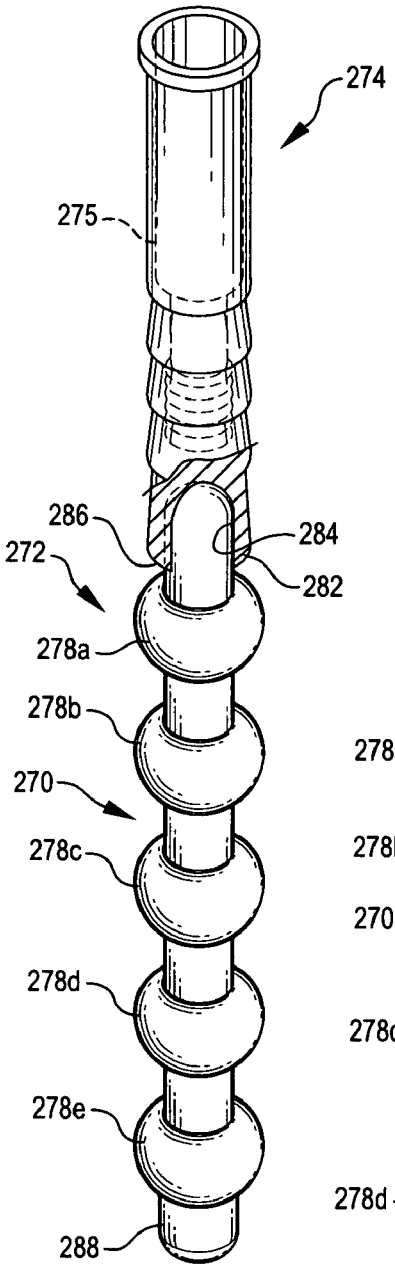
FIG. 21 is an isometric view, to a larger scale, of an assembly composed of the FIG. 20 vibration dampener and arrow point insert.
Figure 22:
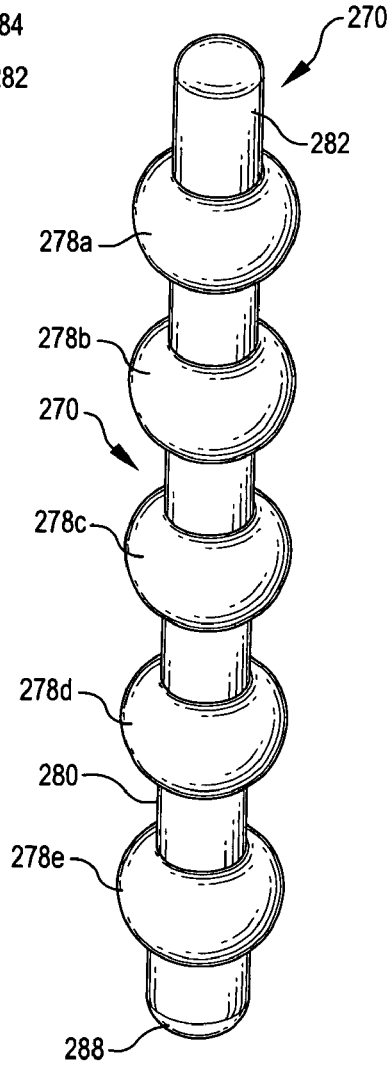
FIG. 22 is a perspective view of the vibration dampener first shown in FIG. 20.
Figure 23:
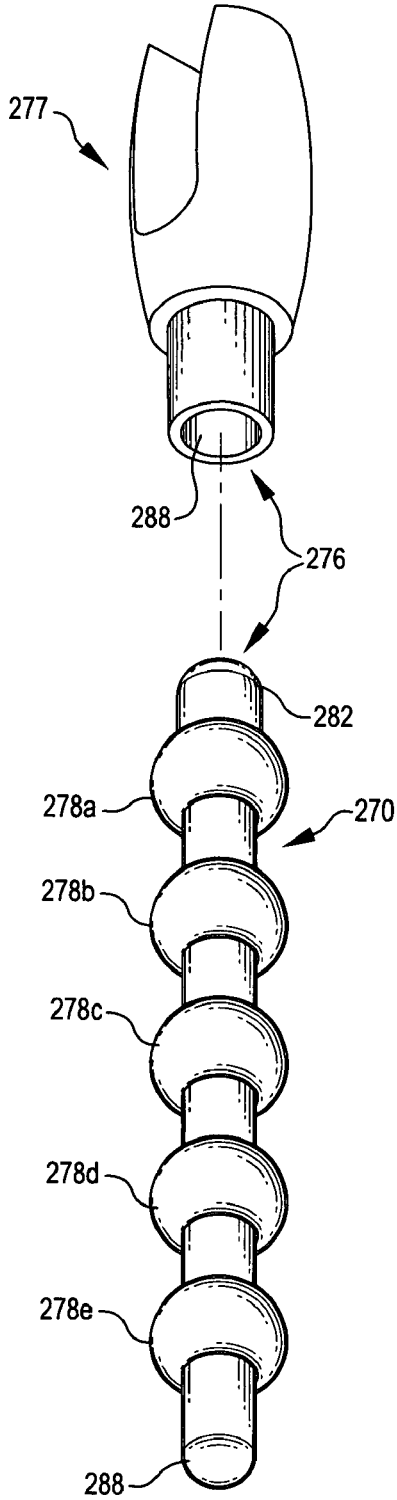
FIG. 23 is an exploded view of a nock end vibration dampener assembly; this assembly includes a nock and a vibration dampener as shown in FIG. 20; and the assembly, dampener, and nock are all constructed in accord with the principles of the present invention.

As shown in FIG. 20, the assembly 272 of dampening device 270 and insert 274 is installed in the rear end 292 of arrow shaft 60 in essentially the same manner that the dampening device/insert assemblies described above are.

Similarly, the assembly 276 of dampening device 270 and nock 277 is installed in the front or forward part 294 of arrow shaft 60 in the same manner that the nock/dampening device 110 depicted in FIG. 2A is. Internal threads 275 are provided for attaching an arrow point (not shown) to the insert.

An appropriate adhesive may be employed to promote the bond between the dampening device end segment 282 and the insert or nock. However, the use of super glue, other cyanoacrylates, and related compounds is preferably avoided as such compounds may degrade the elastomeric dampening device material and lead to its failure or inability to be retained in assembled relationship to an associated arrow point insert or nock.

Figure 24:
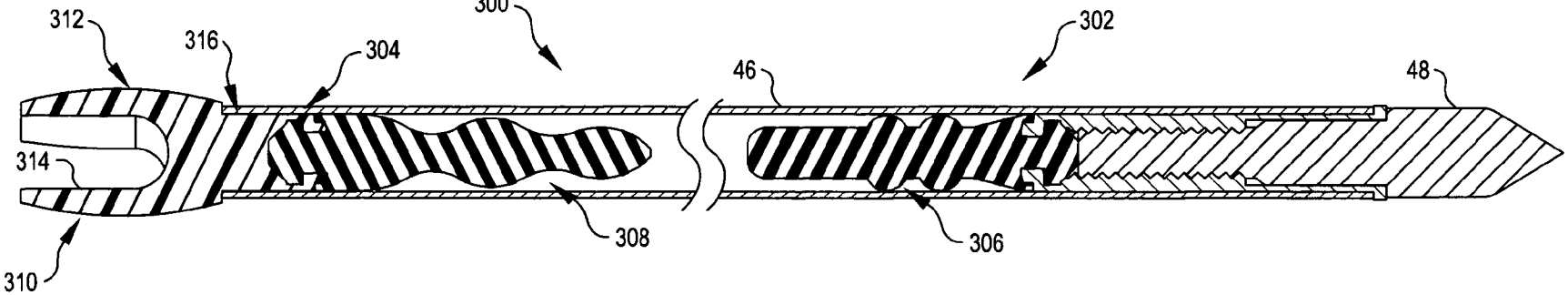
FIG. 24 is a section through an arrow with still other, slip fitting, point end and nock end vibration dampeners; a dampener/nock assembly; and a dampener/point insert assembly; the dampeners, nock, insert, and assemblies all embody the principles of the present invention.
Figure 25:
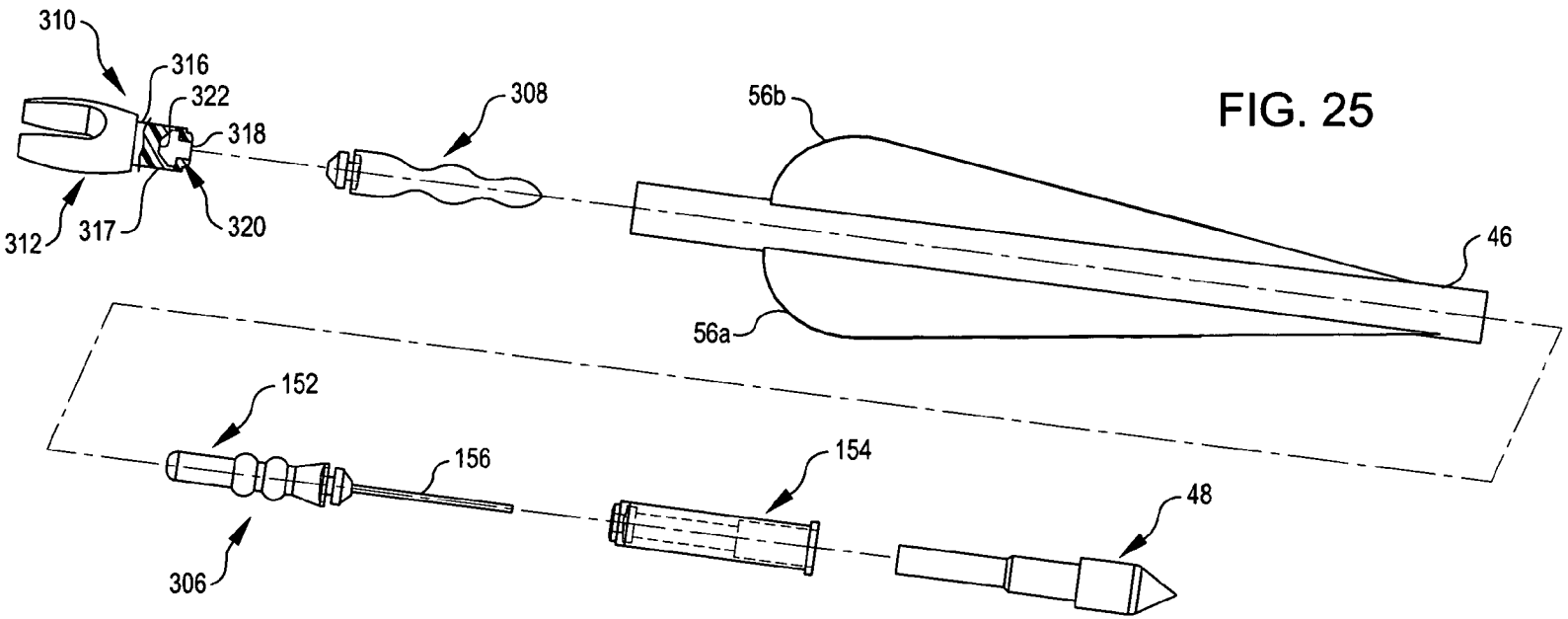
FIG. 25 is an exploded view of the FIG. 24 arrow.

Shown in FIGS. 24 and 25 is an arrow 300 equipped with: (a) a vibration dampener/point insert assembly 302 as described above and illustrated in FIGS. 7-9, and (b) a nock end assembly 304.

Point end assembly 302 comprises a slip fitting vibration dampener 306 and an arrow point insert 130.

Vibration dampener 306 has a sinusoidal configuration like that of the vibration dampener shown in FIGS. 14-16 and a coupling segment 92 with a frustoconical head 86 as first shown in FIGS. 5 and 6.

The nock end assembly 304 is made up of a vibration dampener 308 and a nock 310.

Vibration dampener 308 has a body 224 with a sinusoidal profile and a dampening element 238 as shown in FIGS. 14-16. Axially aligned, and integral, with body 224 is a coupling segment 240, also configured as shown in FIGS. 5 and 6.

Nock 310 has a head 312 with a conventional arrow string-receiving notch 314 and an axially aligned stem 316 with a stepped-down free end segment 317. Formed in stem 316 and opening onto the exposed end 318 of the stem is a first cylindrical and then frustoconical recess 320. The frustoconical segment 322 of recess has a configuration complementing that of vibration dampener head 86. Head 86 is trapped in the frustoconical segment 322 of recess 320, securely locking vibration dampener 306 and arrow point insert 130 together.

In those several representative embodiments of the invention described above, an appropriate lubricating adhesive may be employed to facilitate the installation of the point end or nock end assembly in the arrow shaft. The subsequent curing of the adhesive further serves to keep the assembly in place.

The principles of the present invention may be embodied in forms other than those specifically disclosed herein. Therefore, the present embodiments are to be considered in all respects as illustrative and not restrictive, the scope of the invention being indicated by the appended claims rather than by the foregoing description; and all changes which come within the meaning and range of equivalency of the claims are therefore intended to be embraced herein.

The invention claimed is:

1. The combination of an arrow point insert and a device for dampening vibration of an arrow;

the insert and the dampening device being oriented in an axially aligned relationship;

the arrow point insert having a through bore; and the dampening device having a detachable, assembly-facilitating tail at an end of the dampening device juxtaposed to the insert;

the tail extending through the bore in and beyond the arrow point insert.

2. A combination as defined in claim 1 wherein:

an end of the tail at the insert-juxtaposed end of the dampening device has a weakened, removal-facilitating end configuration.

3. A combination as defined in claim 2 in which the dampening device is fabricated from an elastomer.

4. A method of installing an elastomeric vibration dampener in an arrow which has a hollow shaft, the method comprising the steps of sequentially:

applying an effective amount of a lubricant to an external surface of the vibration dampener; and sliding the lubricated vibration dampener into the hollow arrow shaft.

5. A method as defined in claim 4:

in which the lubricant is an adhesive; and the adhesive is cured after the vibration dampener is installed to promote retention of the dampener in the arrow shaft.

6. A method as defined in claim 4 which includes the step of assembling an arrow point insert to the vibration dampening device prior to the installation of the dampening device in the arrow shaft.

7. The combination of an arrow, an arrow point insert, and a device for dampening vibrations of the arrow;

the arrow having a shaft with a nock end and an arrow point end and an interior which is hollow at the point end of the shaft;

the vibration dampening device being installed in the point end of the arrow shaft;

the arrow point insert being installed in the arrow shaft between the vibration dampening device and the point end of the arrow shaft;

the vibration dampening device comprising an elongated body fabricated from an elastomeric material and having: a first, coupling segment end; a tip terminating in a second, opposite, tip end; a core; and an integral, annular, off-center vibration dampening element surrounding the core;

the dampening device being assembled at its first end to the arrow point insert; and the vibration dampening element being sufficiently far removed from the tip end of the dampening device that the tip of the dampening device can effect decay time modification of vibrations in the device by wigging and jiggling.

8. The combination of an arrow and a device for dampening vibrations of the arrow:

the arrow having a shaft with a nock end and an arrow point end and an interior which is hollow at the point end of the shaft;

the vibration dampening device having an elongated body fabricated from an elastomeric material; and an annular, vibration dampening element surrounding the body; and the vibration dampening device being installed in the point end of the arrow shaft.

9. A combination as defined in claim 8 wherein the vibration dampening device and the arrow point insert have complementary coupling segments at apposed ends of the dampening device and the insert.

10. A combination as defined in claim 9 in which the vibration dampening device and arrow point insert coupling segments have a complementary, interfitting projection and recess arrangement providing a positive connection between the dampening device and the insert.

11. A combination as defined in claim 9 in which:

the coupling segment of the dampening device comprises an integral, transversely oriented head; and the coupling segment of the insert has a head-receiving cut-out of complementary configuration.

12. A combination as defined in claim 11 wherein:

the dampening device coupling segment has a transition element which is integral with the head; and the point insert coupling segment has a complementary, transition receiving slot adjacent and communicating with the cut-out and opening onto an end of the insert juxtaposed to the dampening device such that the cut-out and the slot divide the point insert into facing, resiliently displaceable clamp elements.

13. A combination as defied in claim 9 in which the coupling segment of the dampening device is surrounded by the coupling segment of the arrow point insert.

14. A combination as defined in claim 9 in which the vibration dampening device has a removable, assembly facilitating tail at the coupling segment end of the device.

15. A combination as defined in claim 8 wherein the dampening device has a pressure-relieving bore extending from end to end therethrough.

16. A combination as defined in claim 8:

which comprises an arrow point and an arrow point insert which is slip fitted in the arrow shaft between the vibration dampening device and the point end of the arrow shaft;

the arrow point being mounted to the arrow point insert with an element of the arrow point in point-rotation-preventing relationship with the vibration dampening device.

17. The combination of an arrow and: (a) a device for dampening vibrations of the arrow, (b) an arrow point, and (c) an arrow point insert slip fitted in the arrow shaft between the vibration dampening device and the point end of the arrow shaft:

the arrow having a shaft with a nock end and an arrow point end and an interior which is hollow at the point end of the shaft;

the vibration dampening device: (d) having an elongated body fabricated from an elastomeric material; and (e) being installed in the point end of the arrow shaft;

the arrow point being mounted to the arrow point insert with an element of the arrow point in point-rotation-preventing relationship with the vibration dampening device;

the arrow point insert having a through bore, and the through bore having an internally threaded segment opening onto an end of the insert juxtaposed to the vibration dampening device;

the arrow point having a complementary stem segment threaded into the internally threaded segment; and the stem segment having an end in contact with an apposed end of the vibration dampening device.

18. A combination defined in claim 17 wherein the vibration dampening device has core and plural, integral, vibration dampening elements, the vibration dampening elements being spaced along the core of the damping device.

19. A combination as defined in claim 17 wherein the vibration dampening device has a quasi-toroidal configuration, a disk-like configuration with a substantially rectangular cross-section, or a shouldered disk configuration.

20. A combination of an arrow and a device for dampening vibration of the arrow wherein:

the arrow has a shaft with a nock end and an interior which is hollow at the nock end of the shaft; and the vibration dampening device has an elongated body fabricated from an elastomeric material and is installed in the nock end of the shaft; and the vibration dampening device has an elongated core and an integral, off-center, vibration dampening element surrounding the core.

21. A combination of an arrow and a device for dampening vibration of the arrow wherein:

the arrow has: (a) a shaft with a nock end, (b) an interior which is hollow at the nock end of the shaft, and (c) a nock;

the vibration dampening device has an elongated body fabricated from an elastomeric material and is installed in the nock end of the shaft, and the nock is mounted to the arrow shaft and assembled in end-to-end relationship to the vibration dampening device.

22. A combination as defined in claim 21 wherein the vibration dampening device and the nock have coupling segments at apposed ends of the dampening device and the nock.

23. A combination as defined in claim 21 wherein the vibration dampening device and the nock have coupling segments with interfitting elements at apposed ends thereof.

24. A combination of: (a) a device for dampening vibrations of an arrow, and (b) an arrow point insert:

the vibration dampening device having an elongated body fabricated from an elastomeric material;

the vibration dampening device and the arrow point insert having coupling segments at apposed ends thereof;

the arrow point insert being assembled in an end-to-end relationship to the vibration dampening device by complementary structural elements of the coupling segments; and the coupling segment of the dampening device being surrounded by the coupling segment of the arrow point insert.

25. A combination of: (a) a device for dampening vibrations of an arrow, and (b) an arrow point insert;

the vibration dampening device having an elongated body fabricated from an elastomeric material;

the vibration dampening device and the arrow point insert having coupling segments at apposed ends thereof;

the arrow point insert being assembled in an end-to-end relationship to the vibration dampening device by complementary structural elements of the coupling segments; and the vibration dampening device having a detachable, assembly-facilitating tail at the coupling segment end of the device.

26. A combination of:

(a) a device for dampening vibrations of an arrow, and (b) an arrow point insert;

the vibration dampening device having an elongated body fabricated from an elastomeric material;

the vibration dampening device and the arrow point insert having coupling segments at apposed ends thereof; and the arrow point insert being assembled in an end-to-end relationship to the vibration dampening device by structural elements of the coupling segments which comprise a complementary, interfitting projection and recess arrangement providing positive connection between the dampening device and the insert.

27. A combination of: (a) a device for dampening vibrations of an arrow, and (b) an arrow point insert;

the vibration dampening device having an elongated body fabricated from an elastomeric material;

the vibration dampening device and the arrow point insert having coupling segments at apposed ends thereof;

the coupling segment of the dampening device comprising an integral, transversely oriented head;

the coupling segment of the insert comprising a head-receiving cut-out of complementary configuration; and the arrow point insert being assembled in an end-to-end relationship to the vibration dampening device by the complementary head and cut-out of the dampening device and insert coupling segments.

28. A combination of: (a) a device for dampening vibrations of an arrow, and (b) an arrow point insert;

the vibration dampening device having an elongated core fabricated from an elastomeric material and an integral, off-center, annular, vibration dampening element surrounding the core;

the vibration dampening device and the arrow point insert having coupling segments at apposed ends thereof; and the arrow point insert being assembled in an end-to-end relationship to the vibration dampening device by complementary structural elements of the coupling segments.

* * * * *